US005515543A

United States Patent [19]

Gioello

[11] Patent Number: 5,515,543

[45] Date of Patent: May 14, 1996

[54] MULTILAYERED RIBBED VENTILATING GARMENT

[76] Inventor: Debbie Gioello, 237 Van Cortlandt Park Ave., Yonkers, N.Y. 10705

[21] Appl. No.: 274,237

[22] Filed: Jul. 13, 1994

[51] Int. Cl.[6] ..... A41B 9/00

[52] U.S. Cl. ..... 2/69; 2/DIG. 1

[58] Field of Search ..... 2/69, 81, 82, 85, 2/87, 93, 97, 256, 272, 243.1, DIG. 1; 428/166, 167, 169, 178, 920, 921

[56] References Cited

U.S. PATENT DOCUMENTS

| | | | |
|---|---|---|---|
| 4,451,934 | 6/1984 | Gioello . | |
| 4,615,934 | 10/1986 | Ellison | 66/192 |
| 4,787,219 | 11/1988 | Sato et al. | 66/190 |
| 4,897,886 | 2/1990 | Grilliot et al. . | |
| 5,001,783 | 3/1991 | Grilliot et al. . | |
| 5,131,097 | 7/1992 | Grilliot et al. . | |
| 5,150,476 | 9/1992 | Stratham et al. | 2/93 |
| 5,255,390 | 10/1993 | Gross et al. | 2/DIG. 3 |
| 5,274,849 | 1/1994 | Grilliot et al. . | |

FOREIGN PATENT DOCUMENTS 825256 12/1959 United Kingdom .

*Primary Examiner*—C. D. Crowder
*Assistant Examiner*—Larry D. Worrell, Jr.

[57] ABSTRACT

A garment for aiding in ventilation of a wearer's body for relief from heat and providing a buffer zone between the wearer's body and any force exerted thereon. This garment includes a porous underlayer for absorbing moisture from the wearer's body due to perspiration and is normally worn under a non-porous outerlayer which may be attached to the underlayer. The outerlayer is separated from the underlayer by at least two layered groups of ribs. Each group of ribs includes a number of individual ribs which are spacedly positioned from each other to create channels therebetween. The groups of ribs are positioned so that the ribs of each group of ribs are layered with respect to the ribs of the remaining groups of ribs thereby creating cross-channels throughout the garment. This allows the garment to maintain a uniform comfortable temperature throughout. A pump maybe used to circulate ambient air in the channels and the non-porous outer layer may allow outward passage of moisture while preventing inward passage.

33 Claims, 6 Drawing Sheets

MULTILAYERED RIBBED VENTILATING GARMENT

BACKGROUND OF THE INVENTION

1. Field of the Invention

This invention relates generally to the field of protective garments and more specifically to protective garments having a porous underlayer and used with a non-porous outerlayer separated by a combination of ribs and channels providing protection from both heat and external forces impacting on the wearer.

2. Description of the Prior Art

In the past, people who were involved in certain professions were exposed to environmental conditions such as excessive heat or to situations such as exposure to gunfire which necessitated the wearing of certain protective garments. These garments include bullet proof vests and fireman's coats. The principle problem encountered with wearing garments of this nature is in the non-porosity of the material used in their construction. Due to this non-porosity, excessive heat is allowed to build up and be retained within the clothing during extended periods of stress, exposure to heat, humidity, and the environment. This excessive heat buildup causes great discomfort and may also cause an individual's strength to be drained.

Numerous attempts at producing a ventilating garment have been made in the past.

For example, U.S. Pat. No. 4,897,886 issued on Feb. 6, 1990 discloses a garment made of three layers and an additional spacer layer. This garment acts on the principle of insulation. The spacer layer is positioned between an underlayer and an intermediate layer. A dead air space is formed in the spacer layer and circulation of air is prevented. The air spacer layer thus provides thermal protection. This patent is the parent of three continuation applications which issued into U.S. Pat. Nos. 5,001,783; 5,131,097 and 5,274,849.

Another example is U.S. Pat. No. 4,451,934 issued on Jun. 5, 1984 to the present inventor. This garment comprises a porous underlayer and a plurality of spaced ribs attached to the porous underlayer. The plurality of spaced ribs form channels therebetween. These channels allow for air flow through the garment to remove moisture, due to perspiration of the wearer, from the garment. This garment operates on the principle of convection. This garment may also be formed having a common single layer of ribs wherein the ribs of this common single layer intersect with one another to form pockets. This configuration of intersecting ribs is used in garments that need not vent air flow.

SUMMARY OF THE PRESENT INVENTION

It is an object of the present invention to produce a garment which provides improved ventilation and protective qualities over prior art garments of this type.

It is an object of the present invention to produce a garment having a porous underlayer and a cross configuration of ribs and channels separating the underlayer from a non-porous outerlayer, used in conjunction with the garment, thereby providing a flow path for air between the underlayer and outerlayer and throughout the garment.

It is another object of the present invention to produce a garment which is able to maintain an air space between the underlayer and outerlayer when under pressure.

A still further object of the present invention is to produce a garment having groups of channels in layered relationship with each other between the underlayer and outerlayer wherein either each group of channels or select groups of channels are able to communicate with the ambient atmosphere.

An even further object of the present invention is to produce a garment having cross channels between the underlayer and outerlayer which provide a flow of air through the entire garment thereby maintaining a substantially uniform temperature throughout.

Another object of the present invention is to produce a garment which will maintain a substantially constant temperature throughout when exposed to excessive heat.

An even further object of the present invention is to produce a garment having channels between the underlayer and outerlayer wherein the channels are formed to provide a flow of air throughout the garment, the pressure of air flow varying throughout based upon the channel width at different sections of the garment.

A still further object of the present invention is to produce a garment which is able to cushion forces applied to the garment thus minimizing the effect on a wearer.

The present invention includes a porous underlayer. A non-porous outerlayer is positioned between the underlayer and the outside atmosphere. This outerlayer may be attached as part of the garment, as a separate article adapted for attachment with the garment or worn over the garment. These layers are spaced from one another by at least two groups of ribs. These groups of ribs are positioned in a crosswise layered relationship with one another. Between adjacent ribs in each group are channels. The crosswise relationship between the groups of ribs creates crossing channels. These ribs may cross in any manner, i.e. a horizontal group of ribs positioned atop a vertical group, or opposing diagonally oriented layered groups, etc. The ribs may also extend in any configuration other than a straight line, i.e. a zig-zag configuration, arced, etc . . . The individual ribs are of a diameter normally in the range of ⅛ inch to 2 inches and therefore, adequate spacing is provided between the underlayer and outerlayer for air to flow within the channels and absorption of any external pressure applied to the garment. The diameter of the individual ribs may vary along the length thereof thereby varying the channel width at that point. The channel widths are based upon the garment to be produced, the application of the garment and the area on the garment in which the ribs are positioned. For example, air flowing at a higher volume or rate might be desired at a portion of the wearer's body which heats up more than other parts and produces more perspiration. Therefore a more narrow channel may be desired in that area.

The spacing between the underlayer and outerlayer is also useful, for example, when used in law enforcement wherein a bullet proof vest acts as the outerlayer. When a bullet impacts the bullet proof vest there may be some penetration through the vest. The spacing provided between the vest and the wearer allows for limited penetration of a bullet without any injury to the wearer. The increased spacing provided by the garment of the present invention further insures the safety of the wearer in this situation.

The aforementioned objects, features and advantages of the invention will, in part, become obvious from the following more detailed description of the invention, when taken in conjunction with the accompanying drawings which form an integral part thereof.

DETAILED DESCRIPTION OF THE PREFERRED EMBODIMENT

The garment of the present invention will now be described with reference to the attached drawings.

Figure 1:
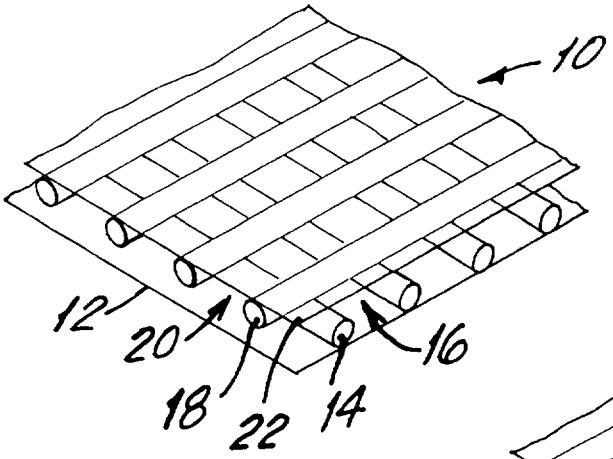
FIG. 1 shows a perspective view of the present invention.
Figure 2:
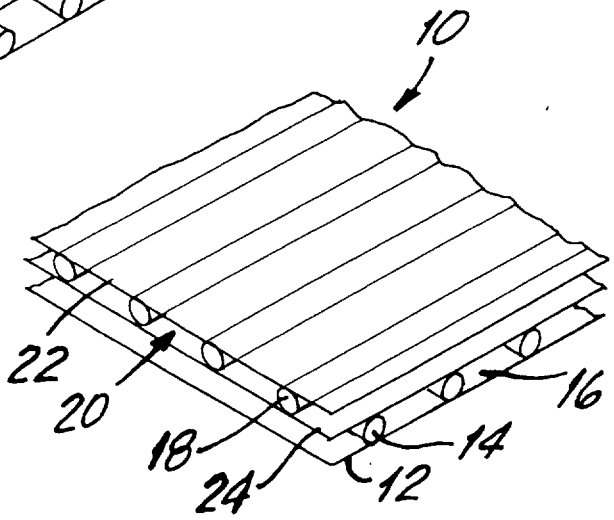
FIG. 2 shows a perspective view of the present invention including a porous layer between the first and second groups of ribs.
Figure 3:
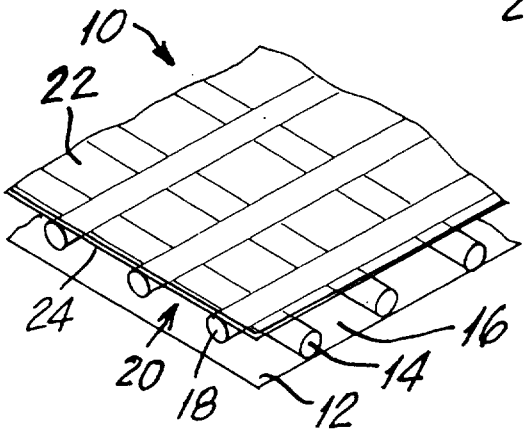
FIG. 3 shows a perspective view of the present invention including a porous layer above the second group of ribs.

A perspective view of the fabric 10 used in making this garment is shown in FIGS. 1–3. This fabric 10 includes a porous underlayer 12. Extending from the porous underlayer 12 is a first group of spaced ribs 14. The first group of ribs 14 is spacedly positioned about the length of the garment so as to create channels 16 therebetween. Extending across and in layered relationship with the first group of ribs 14, on the side opposite the porous underlayer 12, is a second group of ribs 18. The ribs 18 of the second group are also spacedly positioned so as to create channels 20 therebetween. The channels 16 extending between the ribs 14 of the first group, and the channels 20 extending between the ribs 18 of the second group, respectively, extend in a crosswise manner to one another creating cross-channels. A non-porous outer layer 22, as is shown in FIG. 1, may be attached to or removably positioned on a side of the second group of ribs 18 opposite to the first group of ribs 14.

The first porous layer 12, provides a means for attachment for the first and second groups of ribs 14, 18 respectively as will be described hereinafter. This prevents the ribs from rolling or moving when pressure is applied to the garment.

Figure 5:
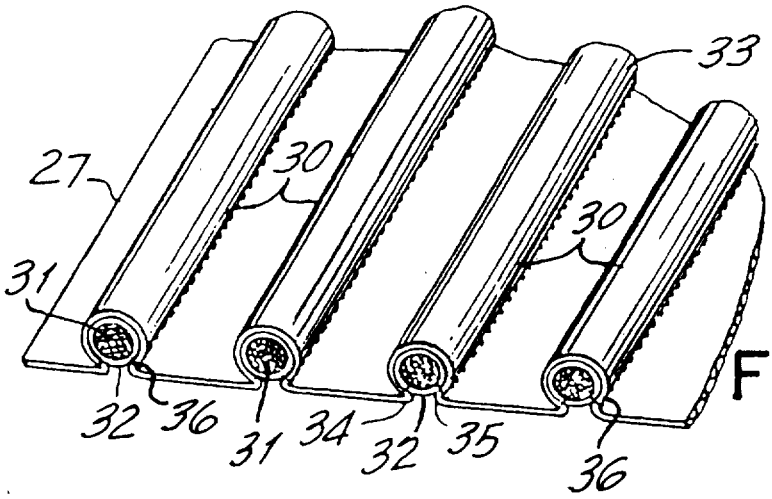
FIG. 5 is a perspective view showing an interconnection between a porous layer and layer of ribs.
Figure 6:
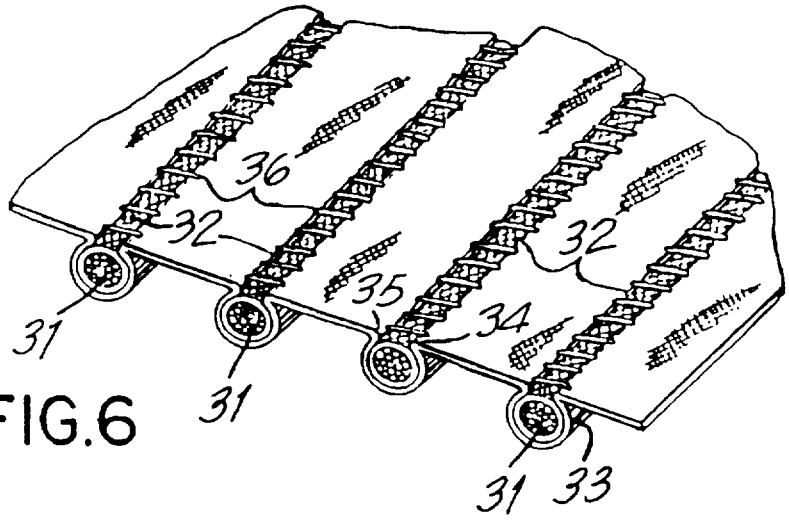
FIG. 6 is a perspective view showing the underside of FIG. 5.
Figure 7:
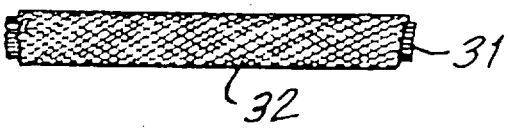
FIG. 7 is an elevational view showing a cording element used as a rib in the present invention.

The ribs may be formed using a fiberfill cord 31 preferably encased in a closely woven or closely knitted jacket 32 as is shown in FIG. 7. The jacket 32 prevents the unraveling of the cord during fabrication, wear and care. As shown in FIG. 5, the cords 31 may be positioned in arcuate portions 33 of a porous layer 27 which overlie approximately seven eighths of the outer surface of the cords 31, and form fold edges 34, 35 in spaced parallel relationship. The edges 34, 35 are interconnected by an elongated chain stitch 36 which overlies the remaining one quarter of the outer surface of the cord 31 as is shown in FIG. 6. By placing the fold edges 34, 35 in spaced parallel relation, when the garment is under tension, this tension is transmitted to the knit stitch configuration which effectively negates any tendency for the ribs to roll from the proper position.

Figure 8:
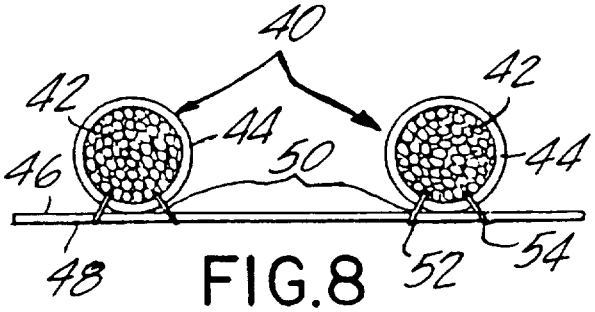
FIG. 8 is an end view of ribs connected to a porous layer.

The ribs 40 may also be fully enclosed fiberfill cords, as can be seen in FIG. 8. They include an inner core 42 of fiberfill material and an outer casing 44. The cords are attached to the outer surface 46 of the fabric 48 by blind stitching 50 along parallel rows 52, 54, sufficiently spaced to prevent rolling of the ribs 40 with respect to the fabric with movement of the wearer.

The ribs may also be formed using foam (not shown). The foam may be positioned, as described and shown in FIGS. 5 and 6, in arcuate portions 33 of a porous layer to form ribs in the same manner as the fiberfill cords to form the ribs. The foam may also be applied directly to the porous fabric to which it is able to adhere. Any other suitable material may also be used to produce the ribs including rods and flexible tubes, e.g. of plastic.

The second group of ribs 18 may also be made of fiberfill cord, foam or other suitable material as described hereinbefore with respect to the first group of ribs. This cord may also be attached to the first group of ribs and positioned on a side opposite the porous underlayer so as to lie in layered relationship thereto as shown and described hereinafter with respect to FIGS. 1–3 and 10. These ribs are somewhat rigid, so they are able to lie straight across the first group of ribs and not sag between the ribs thereby blocking the channels between these ribs.

When a second porous layer 24 is positioned between the first and second groups of ribs 14, 18 respectively as in FIG. 2, or between the second group of ribs 18 and the non-porous outerlayer 22 as in FIG. 3, the second layer of ribs 18 may be formed by positioning the rib material, i.e. fiberfill cord or foam, within arcuate portions of the second porous layer 24 or attached to the outer surface of the second porous layer 24. These properties and attachments of the ribs also hold true for any subsequent groups of ribs layered above the first and second groups.

Figure 10:
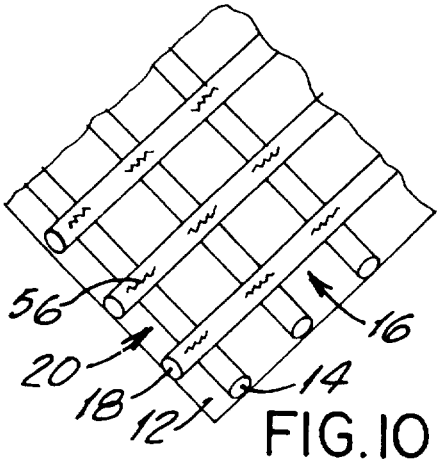
FIG. 10 is a perspective view showing a connection between two layered groups of ribs.
Figure 11:
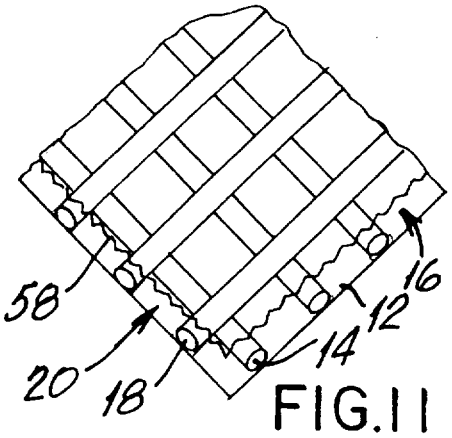
FIG. 11 is a perspective view showing a type of connection between two groups of ribs and a porous layer.
Figure 12:
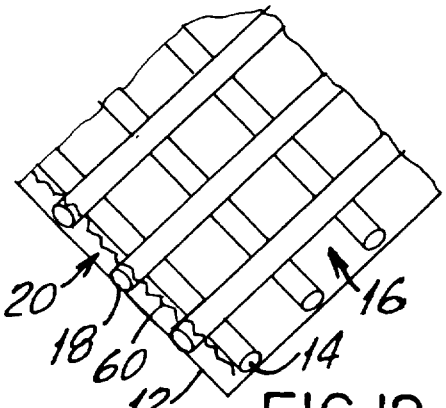
FIG. 12 is a perspective view showing another type of connection between a second layer of ribs and a porous layer.
Figure 13:
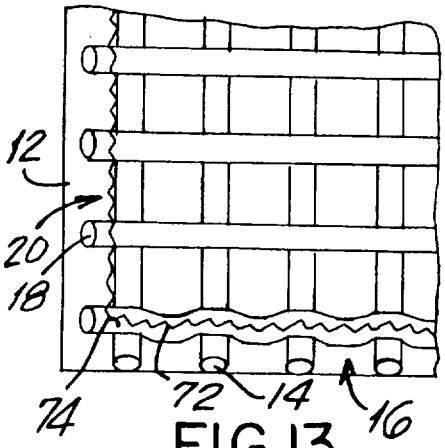
FIG. 13 is a perspective view showing the connection of FIG. 11 wherein stitching across the channels of the first group of ribs is along the length of a rib of the second group thereby blocking the channels of the first group.
Figure 14:
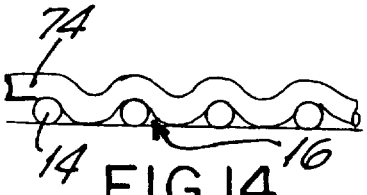
FIG. 14 is a side view of FIG. 13.

The ribs of the first group may be attached to the ribs of the second group at connection points 56 indicated by the crossings of the individual ribs as is shown in FIG. 10. The ribs may be stitched together or they may also be fused to one another using heat at these crossing points 56. This is true for ribs made of fiberfill material or foam. Alternatively a seam may be stitched around the entire garment 58 as shown in FIG. 11 or around select sides 60 thereof, as shown in FIG. 12. These figures show a corner portion of a garment, the seam along all or select sides, 58 and 60 respectively, will be sewn in the same manner. The first group of ribs 14 does not necessarily have to be sewn in this manner as they are already secured to the first porous layer 12. By stitching around the entire garment the second group of ribs 18 will also be attached to the first porous layer 12. When secured in this manner, the ribs of each group will be secured to the first porous layer 12 at their ends but their midsections, not being secured, will be in a freely slidable relationship with each other. Furthermore, their channels will not be closed off unless the stitching 72 across the channels 16 of the first group of ribs 14 is across a rib 74 in the second group 18 causing this rib 74 in the second group of ribs 18 to be sewn in a position within and thereby blocking the channels 16, as shown in FIGS. 13 and 14. This would effectively block the air flow into and out of the channels 16 created between the ribs of the first group 14.

Dependent upon the end use of the garment, the non-porous outerlayer 22 may be permanently attached as an outerlayer of the garment as in FIGS. 2 and 3. Alternatively, the outer-layer may be removably attached through the use of a connecting means such as a zipper or buttons as in FIG. 15. Furthermore, it may be unattached and simply worn over the garment.

Figure 15:
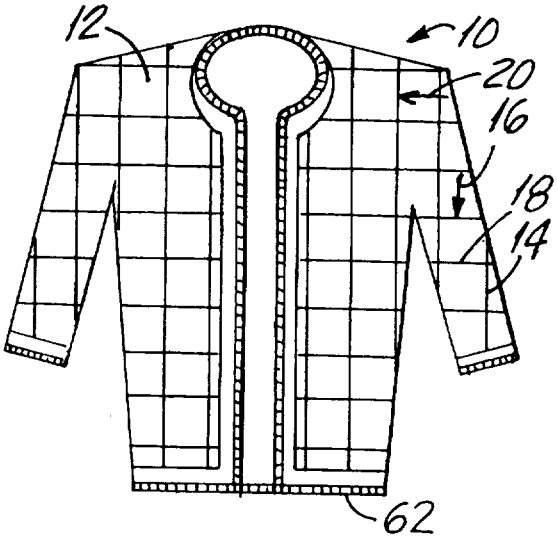
FIG. 15 is a perspective view showing a garment of the present invention adapted with a zipper around its edges for attachment with a non-porous outerlayer.

FIGS. 2 and 3 show a non-porous outerlayer 22 included as part of the garment 10 and positioned atop the second layer of ribs 18. FIG. 15 shows a garment without a non-porous outerlayer but including a zipper attachment 62 around the edges of the garment 10 for attachment to the non-porous outerlayer. The garment 10 thus acts as a removable lining for a non-porous outerlayer. The garment may also be attached as a lining of the non-porous outerlayer using strategically positioned buttons. The non-porous outerlayer will also be adapted for attachment with the garment, i.e. having a zipper attachment around its edges for mating with the garment or having buttons or button holes for mating with the garment.

Figure 17:
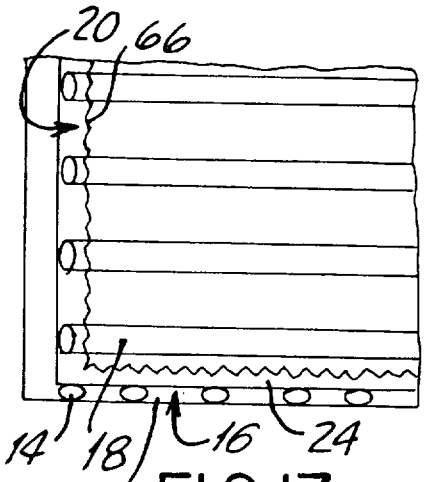
FIG. 17 is a perspective view showing another attachment between two porous layers and two groups of ribs whereby the underlying group of ribs has its channels closed by the second porous layer.
Figure 16:
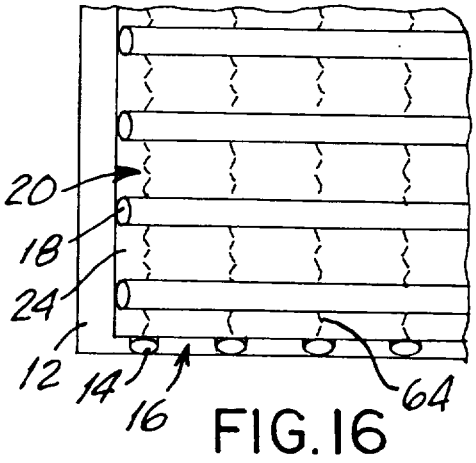
FIG. 16 is a perspective view showing an attachment between a second porous layer and first group of ribs below it.

As can be seen from FIG. 2, a second middle porous layer 24 may be positioned between the first and second groups of ribs 14, 18 respectively, thus physically separating the groups of ribs and their respective channels. As can be seen from FIG. 16, the second porous layer 24 may be attached, at 64, to the ribs 14 of the first group. The second porous layer 24 may be stitched to each individual rib 14 of the first group or only to select ribs. This stitching may also be along the edge of the second porous layer 24, around all or select sides thereof. This would attach the second porous layer 24 to the porous underlayer 12. A connection between the first and second porous layers is shown in FIG. 17. If stitched around all sides, as shown by 66 in FIG. 17, or so as to cross the channels of the first group of ribs 14, the channels 16 of the first group of ribs 14 will be closed to the ambient atmosphere at the point of the stitching. If the stitching runs parallel to the ribs 14 of the first group, then the channels 16 will not be closed off at that point. As with the embodiment having no second porous layer the ribs of the first and second groups 14, 18 respectively are in a freely slidable relationship with each other at their midsections when the stitching of the second porous layer 24 is around the edges thereof.

As shown in FIG. 3, the second porous layer 22 may alternatively be positioned on a side of the second group of ribs 18 opposite the first group of ribs 14. When the second porous layer 24 is positioned in this manner, it may be attached as a layer of the garment in any of the previously described ways. If the second group of ribs 18 is attached directly to the first group of ribs 14 or to the first porous layer 12, then the second porous layer 24 can be attached to either the second layer of ribs 18, the first layer of ribs 14, along its edges to the first porous layer 12 or to any combination of the three. When attaching the second porous layer by stitching in these manners, any channel crossed by the stitching will be closed off at that point as the second porous layer 24 will be secured over the channel and to the base of the channel. When the garment includes a non-porous outerlayer 22 as a permanent part of the garment, the second porous layer 24 will also be attached to this outerlayer 22. The manner of stitching used to attach this layer 24 as well as any of the other layers described hereinbefore depends upon the type of garment to be produced, the end use of the garment and the desired effects of the garment. The different effects produced from such attachments and types of garments which may be produced will be discussed hereinafter.

Figure 4:
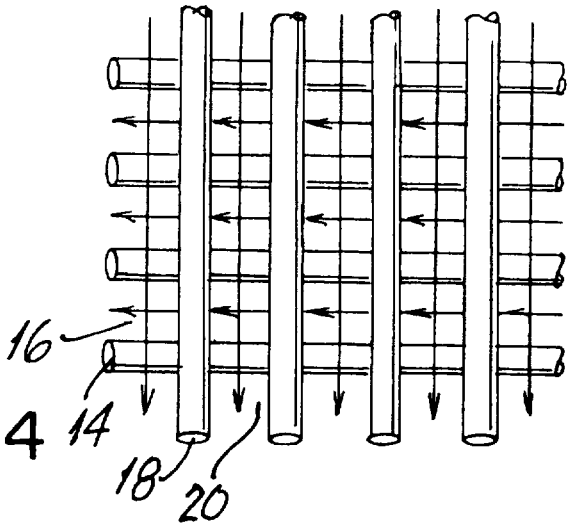
FIG. 4 shows the cross flow of air through the channels formed between the ribs of the first and second groups of ribs.

The layers of ribs, when positioned crosswise atop one another create cross channels as can be seen in FIG. 4. FIG. 4 shows an example of the direction of air flow through the channels of the first and second groups of ribs 14, 18. It can easily be seen that since the channels also communicate with one another the air flowing through one channel can be easily redirected to flow into another channel and throughout the entire garment. The flow of air throughout the entire garment produces and maintains a substantially constant temperature throughout the garment and an even flow of air through all the channels. This adds to the comfort of the wearer and was not obtainable in prior art devices as there was no such communication between individual channels and/or no such air flow throughout the garment. Based upon the above described attachments between the porous layers and the groups of ribs, some or all of the channels may be allowed to communicate with the ambient atmosphere thus providing a natural flow of air through the channels. An end view of a section of a garment is shown in FIGS. 18 and 19 illustrating the first and second groups of ribs in communication with the ambient atmosphere, respectively.

Although in all of the embodiments described herein, reliance is made on natural circulation (free convection) of air in the channels that results from gravity and temperature differentials, in some instances forced circulation may also occur. For example, a person wearing a garment including ribs and channels in accordance with the invention, may bump into an object, lean against a wall, or against the back of a chair when sitting, and such "normal" events can cause a local compression of the garment together with local compression of its channels. Air in the channels is thus compressed and expelled by the reduced local channel volume. The air travels rapidly through the open channel paths. This "natural pumping" can enhance heat transfer and absorption of moisture.

Figure 9:
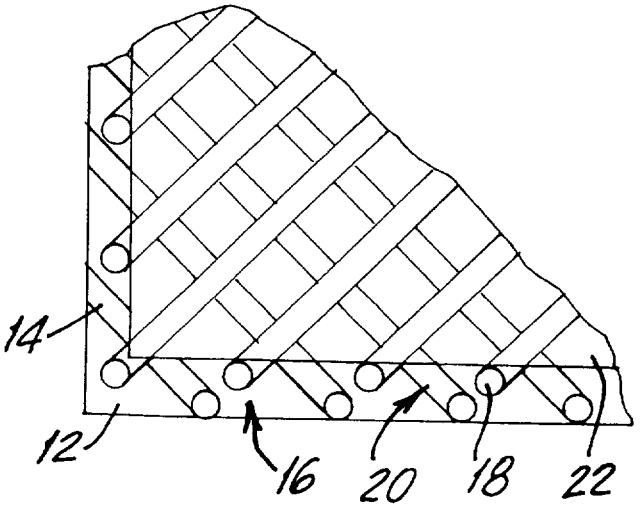
FIG. 9 is a perspective view showing the present invention having groups of ribs positioned diagonally.
Figure 18:
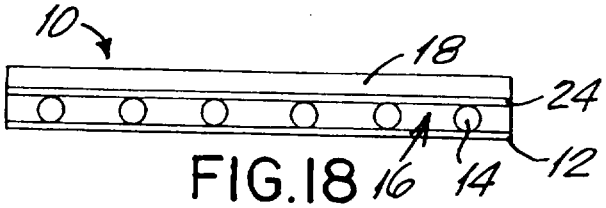
FIG. 18 is an end view of a section of a garment produced according to the present invention showing channels formed between one group of ribs communicating with the ambient atmosphere.
Figure 19:
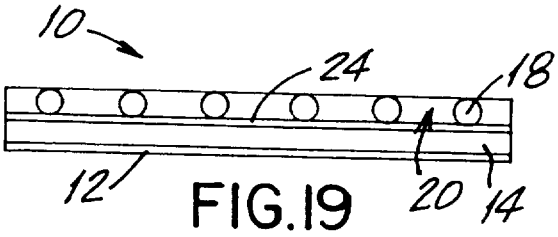
FIG. 19 is an end view of another section of the garment produced according to the present invention showing another group of ribs communicating with the ambient atmosphere.

FIG. 18 shows an end view of a garment wherein the first layer of ribs 14 and the channels 16 therebetween extend to an edge of the garment 10. The channels 16 are open at the edge of the garment and thus able to communicate with the ambient atmosphere. Thus air may flow into and out of the channels 16. As can also be seen from this figure there is a second porous layer 24 above the first group of ribs 14 and a second group of ribs 18 layered crosswise over the second porous layer 24. Because this second group of ribs 18 is layered crosswise in this manner and the ribs 18 do not extend to this edge, the channels therebetween (not shown) are unable to communicate with the ambient atmosphere at this edge. FIG. 19 shows another end view of the garment along an edge wherein the second group of ribs 18 may communicate with the ambient atmosphere and the first group of ribs 14 cannot. Based on the way in which the ribs are laid out on the porous layers and the manner in which the ribs and porous layers are attached, as previously discussed, determines how many individual channels or groups of channels will be able to communicate with the ambient atmosphere and along which edge of the garment this communication will take place. For example, if two layers of ribs were positioned in an opposing diagonal relationship with respect to the garment, as is shown in FIG. 9, the channels between each group of ribs will open along the same edges of the garment. Thus more than one group of channels may be able to communicate with the ambient atmosphere along a single edge of the garment. The total amount of groups of channels which may communicate with the ambient atmosphere along a single edge thus depends on the total number of groups of ribs and the alignment of the groups of ribs.

The ribs may have a diameter in the range of from ⅛ inch to 2 inches or more. Furthermore, the ribs may be separated, to create the channels, by a distance of approximately 2 inches, this separation distance may vary dependent upon the type of garment and application for which the garment is used. The channels thus formed will normally have a width of approximately 2 inches and a depth of approximately ⅛ to 2 inches.

Figure 20:
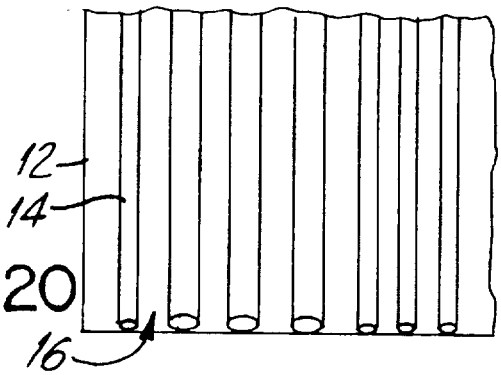
FIG. 20 is a perspective view showing a group of ribs wherein the individual ribs have varying diameters.
Figure 21:
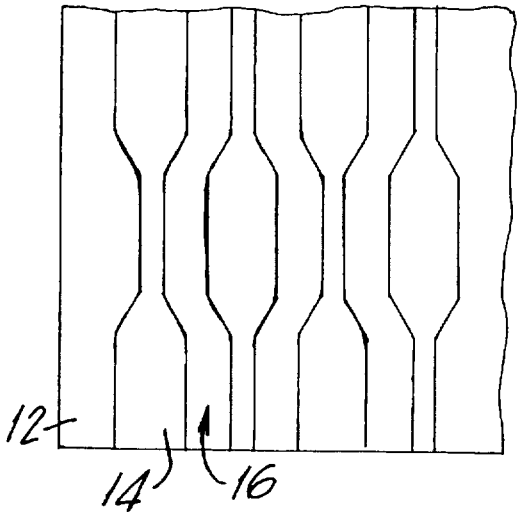
FIG. 21 is a perspective view showing a group of ribs wherein the diameter of the individual ribs varies along the length thereof.

The ribs need not be uniform in diameter as is shown in FIGS. 20 and 21. The ribs of each individual group can have varying diameters as is shown in FIG. 20 and the individual ribs may have varying diameters along their length as is shown in FIG. 21. By varying the diameters of the ribs within a particular group and/or varying the diameter of individual ribs along their respective length, the widths of the channels are changed either with respect to other channels of the group or with respect to other portions of the same channel. The varying of the channel widths causes the air volume and rate of air flow to vary throughout the garment. This varying air volume and flow rate is based upon basic principles of physics. In "natural pumping" (discussed above) when an equivalent amount of air is flowing through two separate passages, the air pressure and flow rate will be greater in the more narrow passage. In an area having a greater air flow rate, the ability of the garment to vaporize the moisture and transport it through the channel thereby cooling that area will also be greater.

This is useful in the garment of the present invention as a person's body temperature is not uniform throughout the body. Some areas of the body include more sweat glands and thus perspire more than other parts. Furthermore, other portions of the body having fewer sweat glands heat up to a greater extent as the natural means for cooling the body in the form of perspiration is not abundantly present. The varying of the channel width by the above means would allow the areas of the body which heat up to a greater extent and the areas which produce more perspiration to be affected more dramatically than other portions of the body thus allowing the garment to more readily cool the body by providing a greater cooling effect to the portions of the body which require it most.

Garments produced based on the present invention would have varying channel widths throughout based on the garment produced and the location on the body which a particular portion of the garment will cover. It is also possible to custom produce such garments based on the different biological and physical characteristics of the individual user. For example, if a user perspires at an abnormally high rate in one area of the body, the garment can be produced having extremely wide channels in that area to locally enhance removal of heat and moisture, while if a person perspires at a similar or below normal rate at all points of their body, then a garment for that person may have channels throughout the garment having a substantially uniform width.

Figure 22:
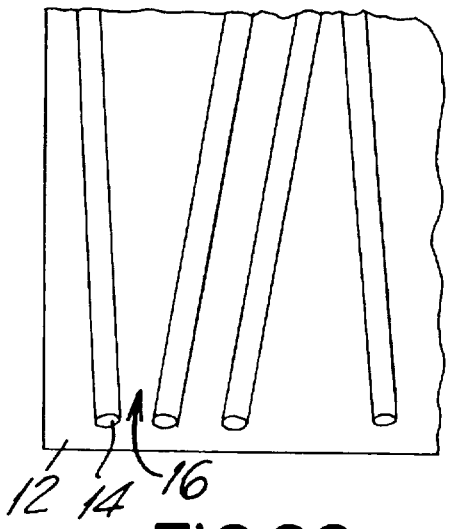
FIG. 22 is a perspective view showing a group of ribs aligned on a porous layer at varying angles to each other.
Figure 23:
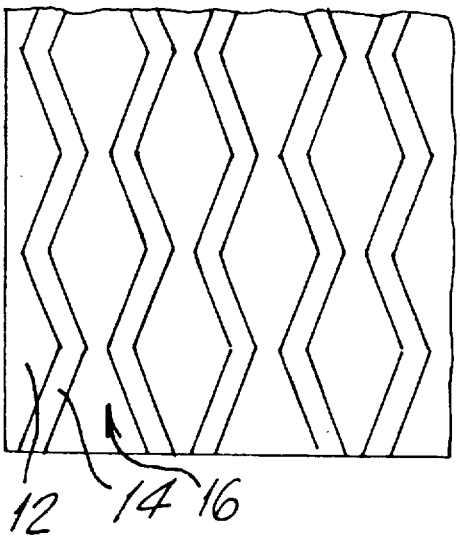
FIG. 23 is a perspective view showing a group of ribs wherein each individual rib is aligned on the porous layer in a zig-zag manner.
Figure 24:
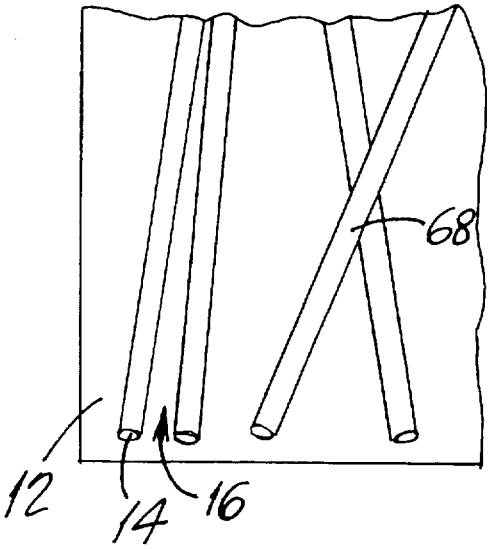
FIG. 24 is a perspective view showing a group of ribs aligned on a porous layer wherein certain ribs intersect each other.

In order to create different flow rates, the ribs may also be positioned in any manner, not necessarily parallel to one another as was shown in the previous figures. The ribs within the individual groups may be aligned at angles with one another as shown in FIG. 22 or may even be positioned in a zig-zag type formation as shown in FIG. 23. The positioning of the ribs may be in any manner so as to produce the desired effect, controlling the air volume and rate of flow throughout the garment. Should it be necessary for the garment to function optimally, the ribs of a group may even intersect each other at certain points as shown in FIG. 24 thus closing off certain channels at the point of intersection. All configurations of rib placement are possible as long as the cross channels exist between the layered groups of ribs so the air may be free to flow throughout the space between the underlayer and any overlayer. This provides the garment with the unique quality of being able to maintain a substantially constant temperature throughout the entire garment as portions of the garment are not secluded or blocked off from any other portions as in prior art garments wherein the ribs produced channels which did not communicate.

A non-porous outerlayer 22 is positioned atop the top group of ribs 18 or atop a porous layer 24, when present. This outerlayer 22 is relatively moisture impervious and prevents moisture and heat from entering the channels of the garment from the outside. This aids in maintaining a substantially uniform temperature throughout the garment as outside factors are minimized. This layer, as described hereinbefore, may be attached to the second porous layer or second group of ribs, removably connected to the garment or used as an outer garment worn on top of the garment of the present invention. When the non-porous layer is permanently attached to the garment it may be stitched around its outside edges to any layer beneath it. It furthermore may be attached to the groups of ribs at any layer thereof to thereby close any desired channels with respect to communication with the ambient atmosphere.

Figure 25:
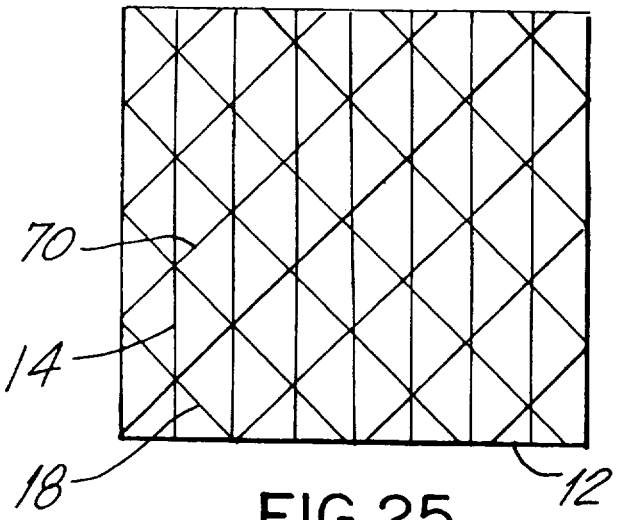
FIG. 25 is a perspective view showing an exemplary alignment of three layered groups of ribs.

It is also possible to produce the garment having the ribs extending at varying angles to one another. For instance the ribs may extend at diagonals to one another as is shown in FIG. 9. It is also possible to produce the garment with multiple layers of ribs, i.e. more than two as shown in FIG. 25. In such a case the multiple layers of ribs may all be positioned at varying angles with each other.

This figure shows a view from above of a piece of fabric of the present invention wherein all porous layers excluding the first porous layer have been removed. There are three groups of ribs layered one atop another in this figure, i.e., 14, 18 and 70. The number of layers used is dependent upon the type of garment to be produced and the uses of that garment.

Figure 26:
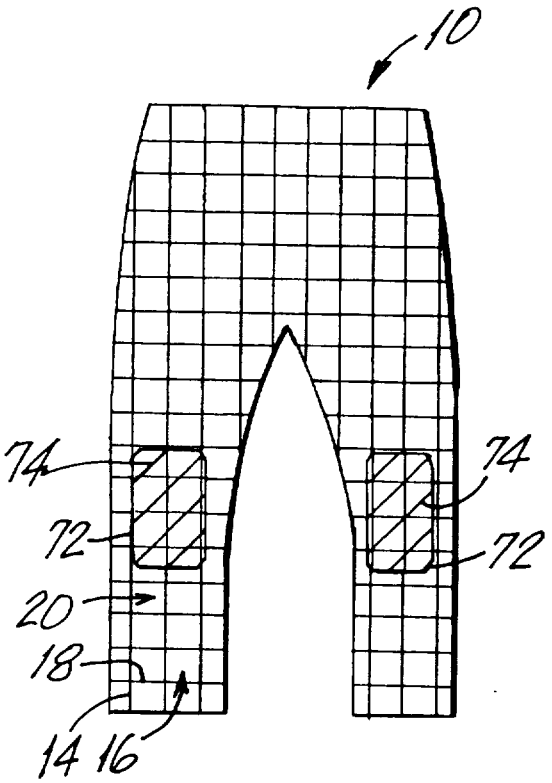
FIG. 26 shows a garment produced according to the present invention having an additional layer in one portion thereof.

Furthermore, the number of layers used need not be uniform throughout, a certain area of a garment may have three layered groups of ribs while the remainder of the garment has two. An example of this might be when the fabric of the present invention is used to produce a pair of pants, as shown in FIG. 26. More padding or protection may be desired in the knee area 72 and thus an added layer of ribs 74 may be used to cover this area while the remainder of the pants has one fewer layers.

A garment made of this material is to be worn such that a bottom side of the porous underlayer 12 contacts the skin of the wearer. When in contact with the skin of the wearer, the porous nature of the fabric allows absorption of perspiration from the wearer. The perspiration is transmitted through the porous underlayer 12 to the channels 16 formed in the first group of ribs 14 and also distributes in the porous underlayer due to the absorbent qualities of the underlayer 12. At high perspiration zones, Wetness of the underlayer 12 tends to be more uniform. The normal convection of air through the channels causes the vaporization of the perspiration for transfer out of the garment. This occurs because at least one of the first and second groups of ribs 14, 18 respectively are in communication with the ambient atmosphere. An end view of a garment produced in accordance with the present invention is shown in FIGS. 18 and 19 and described hereinbefore illustrating the channels between the ribs being open to the outside atmosphere thus allowing communication therebetween. The convection of air also occurs throughout the garment as the channels are positioned to communicate with each other. Air flowing through a channel formed by the first group of ribs may be caused to flow through a channel extending at an angle thereto in the second group of ribs layered thereabove. This provides the garment with a substantially uniform cooling effect throughout as all the air between the underlayer and outerlayer is not restricted to a single channel by the ribs. The air may freely flow throughout the entire garment without impedance thus maintaining a substantially uniform temperature throughout the garment.

Should the garment include a second porous layer 24 between the first group of ribs 14 and the second group of ribs 18, as is illustrated in FIG. 3, the moisture in the channels formed by the first group of ribs 14 is partially absorbed by the second porous layer 24. This moisture is then transmitted through and distributed within the second porous layer 24 and into the channels 20 formed by the second group of ribs 18. This moisture is vaporized by the air flowing in these channels and is carried through the channels.

This fabric may be fashioned to form any number of different type garments or accessories. The fabric may also be combined with another garment or accessory or for a portion or section of a garment or accessory. Types of garments which may be produced from this fabric include but are not limited to shirts, pants and vests. Portions of garments which may be produced include but are not limited to sleeves, collars, a front or back panel of a shirt and even the front or back part of a pant leg. Accessories such as hat liners, gloves, headbands, cod pieces (support for crotch area), shoulder harnesses, knee pads, chaps and body wraps may also be produced.

All garments and accessories using a fabric in accordance with the invention fall within the spirit and scope of the invention. Accordingly, any reference to "garment" hereinafter and in the claims, unless the garment is specifically defined, is intended to include accessories.

This fabric is also useful in producing garments for applications relating to a specific profession. Such professional applications include fireman's apparel, swat team dress, military outfits, sports uniforms, emergency protection, medical applications and policeman's apparel.

Garments made of this fabric are also especially useful for wear by persons employed in the field of law enforcement. In this profession one must always be protected against the possibility of being shot at and hit by a bullet. Even in the most reliable body armor, a bullet is still able to penetrate the body armor to some extent. By wearing a garment made of this fabric wherein the body armor acts as the non-porous outerlayer, an added layer of protection is provided further separating the body armor from the wearer. This is because the diameter of the ribs provides enough space between the body armor and the wearer for a bullet to penetrate the body armor to some extent and come to rest in this space without injuring the wearer. The diameter of the ribs and their rigidity is therefore able to create enough space and enough of a barrier to aid in defusing of the penetration of a bullet. For example a garment having two layers of ribs would provide enough space, i.e. at least ¼ inch, (⅛ inch thickness for each group of ribs) to render the projection dulled and avoid injury to the wearer. For example, vertical ribs and channels as a first layer would provide air flow through the channels and one level of protection while horizontal ribs and channels as a second layer would provide a second level of protection in the form of blunt trauma protection and space to defuse the penetration.

In this regard a ribbed ventilating garment in accordance with the invention may have a first layer of exposed ribs that,in use, is adjacent to the wearer's body. The first layer may be backed by a first porous material layer, which in turn may be backed by an additional layer of ribs forming channels, and an additional outer porous or non porous layer added to the stack. Thus, the first, innermost, rib layer forms channels for ventilation that include the user's body, that is, the skin, or a conventional body undergarment that the user is wearing, serves as a channel wall. Any of the constructions illustrated in the figures can be modified so that a rib layer is positioned to contact the wearer. For example, in FIG. 1, the reference numeral 12 may be considered to illustrate the user's skin and not a porous material (fabric).

Figure 27:
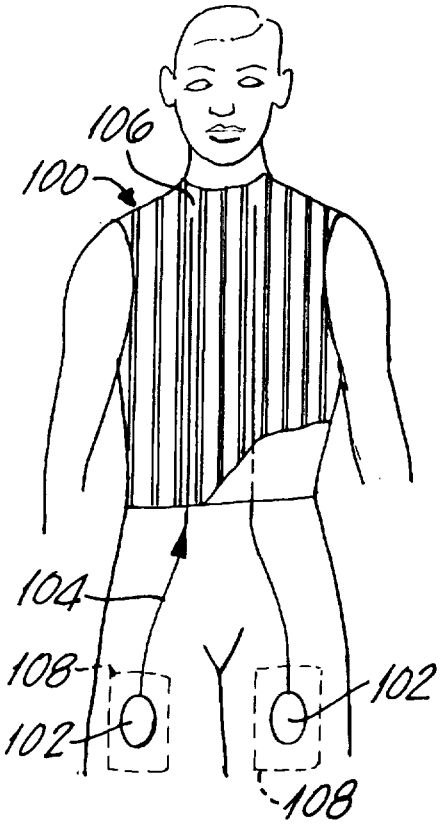
FIG. 27 is a partly cut away front view of another alternative embodiment of a garment in accordance with the invention.

Natural, or free convection and "natural pumping" have been discussed above in describing the ventilation effect of the garment. In other alternative embodiments in accordance with the invention (FIG. 27), forced ventilation is produced by a pump 102, or pumps, which, when operated, forces ambient air into remote regions of the channels and creates circulation as the pumped air migrates through the channel networks, and leaves the garment where the channels communicate with the ambient. To achieve better air distribution in the garment, a manifold or plenum (not shown) would receive the air from the pump 102 and release it, simultaneously to a plurality of channels. The pump 102 may be a conventional bellows device that is compressed and released manually. When compressed, the air in the bellows is forced into an exit tubing 104 that discharges at a remote channel region 106 in the garment 100. Then the bellows is allowed to expand, whereby ambient air is drawn into the bellows chamber through a one-way valve, as is conventional.

The pump may be attached to the user's clothes and perhaps concealed in a pocket 108 (broken line) or beneath a flap that is releasably closed with any convenient fastener(not shown), e.g. zipper, snaps, hook and loop, buttons, etc. In special situations, for example, heat emergencies or rest periods, the user can enhance ventilation, at will, by manually operating the pump or pumps. Electrically powered pumps, that operate from a battery or from an outlet via an AC adaptor, may also be used.

The porous layers, i.e. the underlayer and support layers for the ribs, may be produced from numerous types of fabric. The fabric may be woven, knitted, stretch knit with lycra for maximum stretch, non woven, felted, webbed, laminated, chemically treated or bonded or any other fabric which would produce the results desired. These results being a porous fabric able to absorb moisture, transmit moisture through the fabric and act as a support for attaching the ribs.

The non-porous layer may be made of any suitable material based upon the end use of the garment. This would include a vapor barrier produced from any combination of woven or non woven fabrics.

As indicated above, it is desired that the porous layers also be absorbent of moisture. However, with perhaps less effectiveness in removing moisture, a porous material that is not absorbent may also be used in the layers. Similarly, a non-porous material used in a non porous layer may or may not also have the qualities of moisture absorbency. Accordingly, in the claims, and in the descriptions herein, it should be understood that a porous layer within the scope of the invention always provides porosity but may or may not additionally provide moisture absorbency. A non-porous layer or material within the scope of the invention always has the quality of non-porosity but may or may not additionally have absorbent qualities.

In addition, where recently developed materials are used that have the ability to block transmission of moisture in one direction but allow transmission of moisture in the opposite direction (as in raincoats), these materials may also be used in the spirit and scope of the present inventions when the so-called breathing or semi-conducting material is used in the garments in accordance with the invention so as to provide the qualities described above. Thus, for a garment in accordance with the invention, an outer impervious layer that is intended to keep the ambient conditions from passing through the garment to the wearer, such a "semi-conducting" layer would be oriented to be non-porous from the outside of the garment in the direction toward the wearer. The fact that the semiconductor fabric allows moisture to migrate out of the garment at the same, time provides an additional performance advantage in ventilating the wearer. Generally speaking in use of such a semiconducting layer within the garment, the semiconducting material would be oriented so that moisture can migrate through the semiconductor away from the wearer. When such a semiconducting material is not absorbent in itself, it may be laminated loosely with a layer of absorbent material.

For ribs made of fibers, the fibers may or may not be encased, and in connection with the porous layers, they may be stitched to a porous layer, wet or dry heat sealed in place, bonded by adhesives or laminated or extruded to the porous layers. Furthermore, the ribs may be filled, when either made from folds in the porous layers or formed by encasement in a jacket, with natural fibers, man made fibers, a mixture thereof or even foam which may be extruded. Rods and tubing may also be used as ribs.

For different applications, this fabric performs different functions. When used in a firefighters or foundry workers garment or in garments used in connection with an activity where there is heat build up, the cross layers of ribbed fabric prevents the hot non-porous outerlayer and heat from coming into contact with the wearer's body as well as providing channels for air flow and disbursement of moisture.

In applications involving medical and sports uses the fabric provides protection from equipment and instruments rubbing against the body.

Furthermore when used in connection with contact sports the fabric provides a cushioning effect acting as a buffer between the body and the contact force. This fabric is also very resilient, springing back to its original form after release of the contact force. Because of the type of material used to produce this fabric, a light and comfortable garment can be produced which places minimal restraint on the wearer.

There has been disclosed heretofore the best embodiment of the invention presently contemplated. However, it is to be understood that various changes and modifications may be made thereto without departing from the spirit and scope of the invention.

I claim:

1. A garment for providing a protective and cooling effect on a wearer's body, comprising:

a first layer made of porous material;

a first group of ribs extending from a first side of the first layer wherein each of the first group of ribs are spaced from adjacent ones of said first group of ribs forming channels therebetween; and a second group of ribs attached to and layered a side of the first group of ribs away from the first layer wherein each of the second group of ribs are spaced from adjacent ones of said second group of ribs forming channels therebetween and the second group of ribs is positioned at an angle to the first group of ribs thereby forming crossing channels allowing airflow through the entire garment.

2. A garment as claimed in claim 1, further comprising a second layer made of one of a porous and a non-porous material positioned between the first group of ribs and the second group of ribs.

3. A garment as claimed in claim 1, further comprising a third layer made of one of a porous and a non-porous material positioned on a side of the second group of ribs away from the first group of ribs.

4. A garment as claimed in claim 1, further comprising a third group of ribs, each rib of said third group of ribs being spaced from adjacent ones of said ribs in said third group of ribs forming channels therebetween, the third group of ribs being positioned on a side of said second group of ribs away from to the first group of ribs and at an angle with said ribs of said second group of ribs.

5. A garment as claimed in claim 1, wherein said ribs of both said first and second groups of ribs are each made of a fiberfill material and encased in a jacket.

6. A garment as claimed in claim 2, wherein said ribs of both said first and second groups of ribs are made of foam and said foam is applied directly to said first and second layers to produce the ribs of said first and second groups of ribs respectively.

7. A garment as claimed in claim 3, wherein said ribs of said first and second groups of ribs are made of foam and said foam is applied directly to said first and third layers to produce the ribs of said first and second groups of ribs respectively.

8. A garment as claimed in claim 1, wherein the first group of ribs extend vertically across the garment, when worn, and the second group of ribs extend horizontally across the garment.

9. A garment as claimed in claim 1, wherein the ribs of the first group of ribs extend diagonally across the garment, when worn, and the ribs of the second group of ribs extend diagonally across the garment in a direction opposing the first group of ribs.

10. A garment as claimed in claim 1, further comprising a non-porous layer attached to a side of the second group of ribs away from to the first group of ribs wherein the first and second groups of ribs provide a space between the first porous layer and the non-porous layer.

11. A garment as claimed in claim 1, wherein ribs of each of the first and second groups of ribs are spaced varying distance from adjacent ribs.

12. A garment as claimed in claim 1, wherein ribs of the first and second groups of ribs differ in diameter from one another.

13. A garment as claimed in claim 1, wherein the channels formed between the ribs of at least one of the first and second groups communicate with the ambient atmosphere.

14. A garment as claimed in claim 1, wherein select channels formed between the ribs of at least one of the first and second groups of ribs communicate with the ambient atmosphere.

15. A garment as claimed in claim 1, wherein the first group of ribs are positioned in arcuate portions of the first porous layer.

16. A garment as claimed in claim 2, wherein the first group of ribs are positioned in arcuate portions of the first porous layer and the second group of ribs are positioned in arcuate portions of the second layer.

17. A garment as claimed in claim 3, wherein the first group of ribs are positioned in arcuate portions of the first porous layer and the second group of ribs are positioned in arcuate portions of the third layer.

18. A garment as claimed in claim 10, further comprising attachment means around edges of the garment for removably attaching the non-porous layer to the garment.

19. A garment as claimed in claim 1, wherein select ribs in the first group of ribs intersect with adjacent ribs and select ribs in the second group of ribs intersect with adjacent ribs.

20. A garment as claimed in claim 1, wherein select ones of the individual ribs of the first and second groups of ribs have varying diameters along the length thereof.

21. A garment as claimed in claim 1, wherein ribs of at least one of the first and second group of ribs extends in a zig-zag fashion across the garment.

22. A garment for providing a protective and cooling effect on a wearer's body,comprising:

a first group of ribs, said ribs in said first group being spaced one from the other to form channels therebetween;

a first layer of material being positioned on one side of said first group of ribs, said material being one of porous and non-porous;

at least one additional group of spaced ribs located on said one side of said first group of ribs, said at least one additional group of ribs being located in at least one of a position (a) between said first group of ribs and said first layer of material, and (b) on a side of said first layer of material away from said first group of ribs, said garment being wearable with said first group of ribs in contact with said wearer's body.

23. A garment as in claim 22, wherein said ribs in any one of said groups are at an angle with the ribs of an adjacent group of ribs.

24. A garment as in claim 22, wherein said first layer of material is porous, further comprising at least one additional layer of material, each one of said at least one additional layer being separated from every other layer of material by at least one said group of ribs, said at least one additional layer being positioned on said one side of said first group of ribs.

25. A garment as in claim 24, wherein said at least one additional layer of material is one of porous and non-porous.

26. A garment as in claim 22, further comprising pumping means for delivering a gas into at least one of said channels for enhancing ventilation in said channels.

27. A garment as in claim 26, wherein said gas is ambient air, said pumping means including an inlet for ambient air.

28. A garment as in claim 26, wherein said pumping means is manually operated.

29. A garment as in claim 1, further comprising pumping means for delivering a gas into at least one of said channels for enhancing ventilation in said channels.

30. A garment as in claim 29, wherein said gas is ambient air, said pumping means including an inlet for ambient air.

31. A garment as in claim 29, wherein said pumping means is manually operated.

32. A garment as in claim 22, wherein in use of said garment, one layer of said at least one layer of material allows moisture to pass in the direction away from the wearer and blocks moisture passage in the opposite direction.

33. A garment as in claim 32, wherein said one layer of said at least one layer of material is an outermost layer of material.

* * * * *